United States Patent [19]

Bertrand et al.

[11] Patent Number: 4,890,327

[45] Date of Patent: Dec. 26, 1989

[54] MULTI-RATE DIGITAL VOICE CODER APPARATUS

[75] Inventors: John Bertrand, Upper Nyack, N.Y.; Matthew J. Noah, Detroit Lakes, Minn.

[73] Assignee: ITT Corporation, New York, N.Y.

[21] Appl. No.: 57,474

[22] Filed: Jun. 3, 1987

[51] Int. Cl.[4] ..... G10L 7/02

[52] U.S. Cl. ..... 381/38

[58] Field of Search ..... 381/36–40, 381/41, 29–32, 43–47; 364/513.5; 375/122

[56] References Cited

U.S. PATENT DOCUMENTS

| | | | |
|---|---|---|---|
| Re. 32,124 | 4/1986 | Atal | 381/36 |
| 4,472,832 | 9/1984 | Atal et al. | 381/40 |
| 4,669,120 | 5/1987 | Ono | 381/40 |
| 4,710,959 | 12/1987 | Feldman et al. | 381/36 |
| 4,716,592 | 12/1987 | Ozawa et al. | 381/40 |
| 4,720,861 | 1/1988 | Bertrand | 381/36 |
| 4,720,865 | 1/1988 | Taguchi | 381/49 |

*Primary Examiner*—David L. Clark
*Assistant Examiner*—John A. Merecki
*Attorney, Agent, or Firm*—Thomas N. Twomey; Mary C. Werner

[57] ABSTRACT

An analog to digital converter for a speech signal is implemented in modules to allow for changes in bit rate and changes in bit stream length according to requirements of the digital transmission system. A pre-emphasis circuit provides an array of pre-emphasized speech samples which are stored in memory. A linear predictive coder provides an array of reflection coefficients and an array of filter coefficients. A pulse processor receives the speech samples and filter coefficients and generates speech amplitude and location signals. These signals are multiplied to generate quantized speech samples. The quantized speech samples and reflection coefficients are provided to a buffer which provides an output signal of a proper bit stream length and bit rate for the digital transmission system.

15 Claims, 4 Drawing Sheets

MULTI-RATE DIGITAL VOICE CODER APPARATUS

BACKGROUND OF THE INVENTION

This invention relates to apparatus for digitizing analog speech and more particularly to apparatus for providing compressed speech to allow transmission of such compressed speech over conventional communication channels.

Presently, many modern switching systems employ digital data which is transmitted from a first location to a second location through a digital switching system. In such systems, digital signals are employed throughout the system in order to increase system reliability and to further alleviate many of the problems involved with the transmission of analog data. In this manner conventional analog signals are converted to digital signals such as pulse code modulated signals and are transmitted through the switching network over existing communications channels.

As one can ascertain, such switching networks accommodate various transmission capabilities. In this manner, the number of bits as well as the bit rate of the signal varies according to the particular modems employed and in regard to the capacity of the transmission lines associated with such a system. A basic problem which has existed with regard to the digitization and transmission of analog speech involves the fact that the analog speech typically resides in a frequency range from zero to around 3 KHZ. In regard to digitizing such speech one must use a rate which is high enough to satisfy the Nyquist criterion of sampling and hence employ a frequency of twice the bandwidth. That would result in a sampling rate of approximately 8 KHZ.

Assuming that 10 bits would be sufficient to describe the amplitude of the speech wave for each sample, the required bit transmission rate would be 80 kilobits per second. This for example is not capable of being handled by conventional telephone lines. The prior art is cognizant of such problems and employed a technique designated as linear predictive coding (LPC). Linear predictive coding (LPC) uses a parametric model of the human vocal system to encode speech. This model describes speech production as being controlled by three factors. A first factor is the excitation source which is the energy or gain of a signal and the shape of the acoustic cavity from the epiglottis to the lips. Speech signals can either be voiced such as the A in Ape or unvoiced as the S in Sister.

In any event, the excitation mechanism for the voice signal is modeled by a series of pulses separated by a fixed pitch. The excitation source for the unvoiced signal is modeled as a noise generator. The shape of the acoustic cavity is represented by a plurality of resonant circuits tuned to give information regarding the natural frequencies of the analog speech. The linear predictive coding technique takes advantage of the fact that many speech parameters will not change for a considerable number of samples during a typical speech pattern. Thus, linear predictive coding models typically use an analysis frame containing many samples to arrive at a composite profile for the speech frame before transmitting information on the channel. A commonly used analysis frame duration is 180 samples.

Thus, the channel bit transmission rate can be of the order of a few kilobits per second, a number which such channels as ordinary telephone lines is capable of transmitting. The linear predictive coding technique has been discussed in many technical papers. For example, see an article of A. Buzo et al, entitled "Speech Coding Based on Vector Quantization", I.E.E.E. Transactions on ASSP, Oct. 1980. See also an article by B. S. Atal and J.M. Remde entitled "A New Model of LPC Excitation. . .", Proceedings 1982 ICASSP., pages 614–617. See also an article by Parker et al entitled "Low Bit Rate Speech Enhancement. . .",Proceedings 1984 ICASSP, pages 1.5.1–1.5.4.

As one can ascertain from the prior art, there are problems in transmitting digitized speech over transmission lines or telephone lines. There is a desire to transmit digitized speech of high quality at required bit rates or at multiple rates according to the qualities and characteristics of the switching system or the transmission medium. In providing multiple rate capability, one must assure that the speech processing in regard to quality is suitable for purposes of reconverting the digitized speech back into analog signals without losing excessive information content.

The prior art was cognizant of providing apparatus wherein analog speech was digitized and transmitted over a channel at a minimum bit rate and yet allowing such speech to be synthesized at the receiver end with high intelligibility and quality. In any event, as indicated above, based on modern communication systems, such as digital switching systems employing digital transmissions, one must provide the digitization of analog speech in a digital format which format is capable of providing high speech quality with the required bit rate and having the further capability of varying the rate to accommodate different modems or different transmission requirements For examples of certain prior art techniques, reference is made to a patent application entitled DIGITAL SPEECH CODING CIRCUIT filed on Dec. 24, 1985 for J. Bertrand as Serial No. 813,110 and assigned to the assignee herein, now U.S. Pat. No. 4,720,861, issued Jan. 19, 1988.

This application relates to a digital speech coding apparatus circuit which makes use of linear predictive coding, vector quantization, Huffman coding, and excitation estimation to produce digital representations of human speech having bit rates low enough to be transmitted over telephone lines and at the same time capable of being synthesized in the receiver portion of the circuit to produce analog speech of high intelligibility and quality.

The transmitter portion of the circuit comprises a series connection of a lowpass filter, analog-to-digital converter, a linear predictive coding module comprising five resonators for establishing five center frequencies and bandwidths of the analog speech, a vector quantization module for providing a binary representation of the likely combinations of resonance found in human speech, a Huffman coding module, a variable bit rate to fixed bit rate converter and optionally an encryption module. Another branch of the transmitter circuit extends from the output of the analog to digital converter to the bit rate converter and comprises a series combination of an inverse filter and an excitation estimation module having parallel outputs respectively representative of a voiced/unvoiced signal, the excitation amplitude, and the excitation pulse position. The receiver portion of the circuit comprises a series connection of a fixed bit rate to variable rate converter, a bit unmapping module which produces separate outputs representative of the reflection coefficients and excitation of the speech. The synthesis filter which receives these outputs produces a digital signal representative of the analog speech and converts the signal to audio by a digital to analog converter and a lowpass filter.

As indicated, the prior art is cognizant of the necessity of providing digital speech coders and reference is also made to U.S. Pat. No. 4,472,832 issued on Sept. 18, 1984 to B. S. Atal et al and entitled DIGITAL SPEECH CODER. In that patent there is shown a speech analysis and synthesis system where an LPC parameter and a modified residual signal for excitation is transmitted. The excitation signal is the crosscorrelation of the residual signal and the LPC recreated original signal. Essentially, the patent recognizes the act that digital speech communication systems including voice storage and voice response facilities may utilize signal compression to produce the bit rate needed for storage and/or transmission.

The patent then describes a sequential pattern processing arrangement which sequential pattern is partitioned into successive time intervals In each time interval a set of signals representative of the interval sequential pattern and a signal representative of the differences between the interval sequential pattern and the interval representative signal are generated.

The speech pattern is partitioned in successive time intervals. In each interval a set of signals representative of the speech pattern and a signal representative of the differences between the interval speech pattern are generated.

In this manner one can obtain a compression of speech after the speech has been digitized. Thus, as indicated, the prior art has been concerned with the problem and concerned with devices which enable one to compress speech to allow transmission without sacrificing speech quality. See also an article entitled "Improved Pulse Search Algorithms For Multi-Pulse Excited Speech Coder" by S. Ono, T. Araseki, and K. Ozawa of the NEC Corporation of Japan, published 1984 at the Globe Com Conference in Atlanta, Ga.

It is an object of the present invention to provide a multi-rate digital voice coder which voice coder allows one to compress speech to allow digital speech to be transmitted over conventional communications channels such as telephone links.

It is a further object of the present invention to provide a multi-rate digital voice coder apparatus which enables one to preserve high speech quality after digitization which digitized signal is capable of being transmitted at different rates for accommodating different transmission channels.

It is a further object of the present invention to provide a multi-rate digital voice coder apparatus which enables one to provide compressed speech for more efficient digital transmission and storage.

BRIEF DESCRIPTION OF PREFERRED EMBODIMENT

Apparatus for converting analog speech into a digital signal for transmission of said digital signal over a conventional communications channel, comprising pre-emphasis means responsive to said analog speech at an input and operative to provide at an output an array of pre-emphasized speech samples, memory means coupled to said pre-emphasis means for storing said array of samples in contiguous storage locations, linear predictive coder means coupled to said pre-emphasis means and said memory means and responsive to said stored samples to provide a first array of reflection coefficients at a first output and a second array of filter coefficients at a second output, pulse processing means coupled to said pre-emphasis means and said linear predicative coder means and responsive to said speech samples and said filter coefficients to provide at a first output a first series of pulses indicative of speech amplitude and at a second output a second series of pulses indicative of speech location and including encoder means coupled to said first and second outputs for providing a stream of pulses indicative of a product code of said first and second series of pulses indicative of quantized speech samples, output buffer means having a first input coupled to said first output of said linear predictive coding means for receiving said reflection coefficients and a second input coupled to said pulse processing means for receiving said stream of pulses for providing at an output a digital signal of a given length bit stream having a bit rate determined according to said communications channel.

DETAILED DESCRIPTION OF FIGURES

Figure 1:
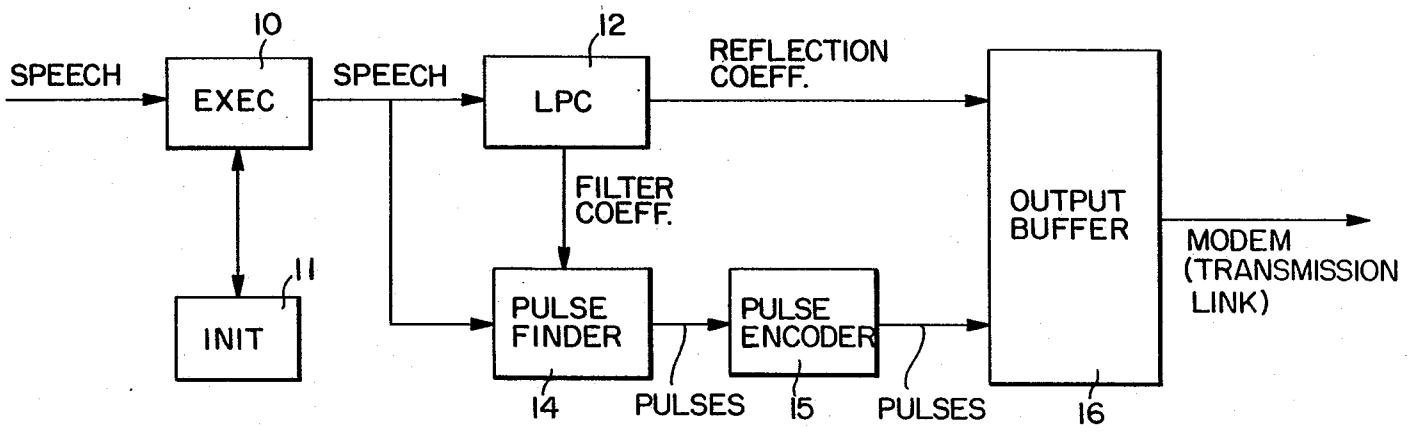
FIG. 1 a block diagram showing a transmitter analysis section of a multi-rate digital voice coder according to this invention.

Referring to FIG. 1, there is shown a block diagram of a portion of a multi-pulse linear predictive coder (MPLPC). The coder to be described is capable of providing multi-rate digitized bit formats which are indicative of digitized voice signals and which are capable of being transmitted to a conventional modem.

The block diagram of FIG. 1 shows the MPLPC transmitting and analyzing section. The module shown in FIG. 1 and which will be described is capable of converting analog speech to a digital format and outputting the digital format at variable bit rates and variable transmission rates to accommodate different modems or different transmission channels.

As shown in FIG. 1, incoming speech is first directed to a module 10 designated as EXEC which essentially is an execution module as will be further explained. The module 10 is coupled to a module 11 designated as INIT. This module is an analysis initialization module and essentially serves to initialize the system prior to processing of speech. The output of the EXEC module 10 is directed to a PPC module 12. The function of the LPC module is to derive a linear predictive code from the speech samples.

Speech output of the EXEC module 10 is also directed to an input of a pulse-finder module 14. The pulse-finder module 14 receives another input from the LPC module 12. As will be explained, the output of the pulse-finder module 14 provides a series of pulses indicative of the processed speech. These pulses are directed to a pulse encoder 15. An output buffer 16 receives one output from the LPC module 12 and one output from the pulse coder 15. The output buffer 16 as will be explained stores and transmits the information from the LPC module 12 and the pulse encoder module 15 to produce a digital stream at a given bit rate and at a given transmission rate for application to a modem or communications channel.

As will be further explained, the rates of the digital stream can be varied accordingly to accommodate various transmission requirements. It is immediately understood as it is conventional with speech processing circuitry that each and every module as for example shown in FIG. 1 can be implemented by means of microprocessors and hence the functions to be described can be implemented by either hardware or software.

As will be further explained each of the modules in FIG. 1 has a well defined boundary with specific inputs and outputs. In most cases it is possible to exchange a function with a substitute function to obtain a modification of system operation. For example, the module marked pulse encoder as 15 of FIG. 1 could represent a simple scalar quantization of the pulse locations and amplitudes. This could be exchanged with a more sophisticated type of quantizer.

Essentially, a major feature of the present invention as will be explained is based on the modular structure of the architecture which can, as indicated, be implemented by conventional integrated circuitry or by means of suitable software programs. The modularity leads to the ease of accommodating different system requirements. In this manner, each module will be discussed and defined in terms of its function, its inputs and outputs and hence the exact nature of the module is thus determined.

In regard to the following discussion, a variable name is given in capitalized letters for example LIR. In this manner the value of that variable is given as a variable name preceded by *, e.g. * LIR. The name of the variable and its memory address are shown as the name of the variable as for example the external data memory address of the variable LIR is LIR. One memory location greater than LIR has the address LIR-1. If 16 is the value of the variable LIR then *LIR=16.

Figure 2:
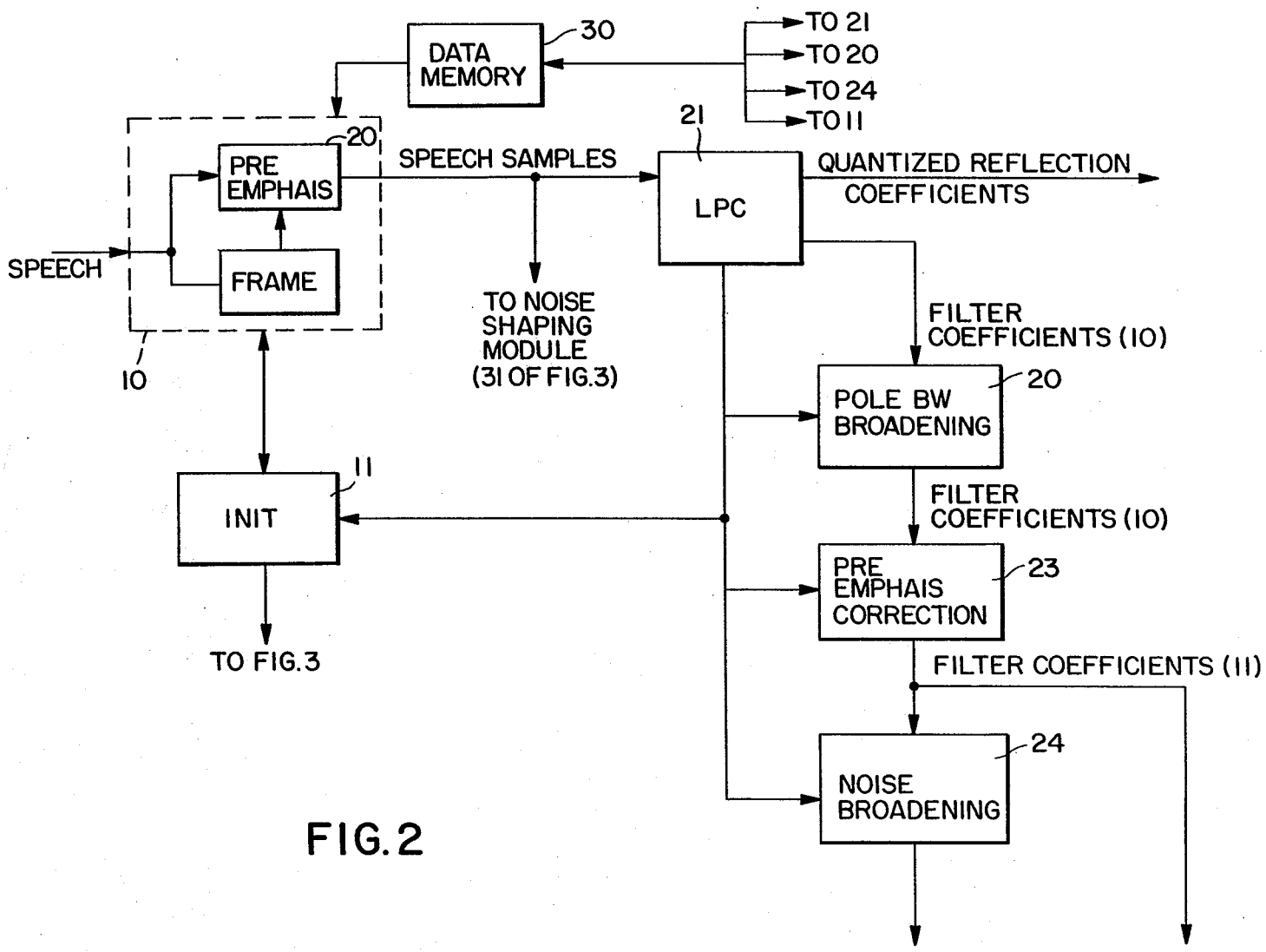
FIG. 2 is a detailed block diagram showing an LPC analyzer section associated with the module shown in FIG. 1.

Referring to FIG. 2, there is shown a more detailed block diagram showing the processing of speech as performed for example by the modules of FIG. 1. In FIG. 2, there is shown a pre-emphasis module 20. Essentially, the pre-emphasis module 20 is contained within the EXEC module 10 of FIG. 1 which is again coupled to the analysis initialization or INIT module 11.

Inputs for the Pre-Emphasis module 20 all come from the EXEC module 10 and the Analysis Initialization module INIT 11. The EXEC module 10 provides N samples of speech stored contiguously in an external data memory 30 starting at a location referenced by the base name ATODIN. The number of samples N, is given by the variable LFRAME. LFRAME is either the value given by FSIZ, one less than FSIZ or one greater than FSIZ. FSIZ is a fixed value given by the Analysis Initialization module 11.

The Analysis Initialization module 11 provides a single sixteen bit quantity called PREFAC which contains the preemphasis factor. It also provides a single sixteen bit quantity called BEGIN.

The pre-emphasis 20 uses data starting at the location specified by ATODIN and BEGIN. It subtracts the value of BEGIN from the base name ATODIN to find the first valid input sample. For example, if the value in BEGIN is 11 then the first input sample is to be found in ATODIN -11.

The pre-emphasis module 20 provides an array of preemphasized speech samples stored contiguously in external data memory 30 starting at a location referenced by the base name PRSPCH. The number of samples stored at PRSPCH is given by the value of the variable FSIZ.

The module 20 performs the pre-emphasis on the input speech. The first value of the speech data, i.e. $x_0$ is stored K samples in front of the ATODIN array. The value K is specified in the variable BEGIN. The pre-emphasis factor is $\alpha$. The pre-emphasis equation is shown below.

$$Y_i = X_i - \alpha^* X_i - 1 \quad i = 1,2,3 \ldots, {}^*FSIZ \qquad \text{Equation 1}$$

Note that $x_o$ is stored in the location ATODIN-(*BEGIN). The pre-emphasis of speech signals is known in the prior art and has been employed with analog speech. Inputs for the LPC module 21 come from the Pre-Emphasis module 20 and the Analysis Initialization module 11. The pre-emphasized speech is passed from the Pre-Emphasis module 20 via storage in the external data RAM or memory 30. The pre-emphasized speech is stored contiguously starting at a location referenced by the base name PRSPCH. The number of speech samples stored is given by the variable FSIZ. The order of the LPC filter is stored in the variable ORDER.

The LPC module 21 outputs an array of filter coefficients and an array of quantized reflection coefficients. The reflection coefficients ($a_O$–$a_n$) are outputted to the buffer 16 of FIG. 1. Each filter coefficient is stored as a single word. $a_o$ is equal to one and need not be stored. $a_1$ through $a_n$ are stored beginning at the location referenced by the base name ACOEFF. N is the order of the LPC filter as specified by the variable ORDER. $a_1$ is stored in location ACOEFF -1 while $a_n$ is stored in location ACOEFF -n. The value stored in location ACOEFF -0 is a shift factor, $\beta$ used to scale the rest of the coefficients. The actual value of coefficient $a_i$ is obtained by multiplying by $2^\beta$.

The quantized reflection coefficients are stored in an array referenced by the base name QRC. $k_1$ is stored at QRC while $k_{10}$ is stored at QRC -9. The quantization is done in accordance with typical industrial standards.

The LPC module 21 accepts pre-emphasized speech samples from the current frame and performs the LPC analysis as known in the prior art. The analysis referred to here is an LPC covariance analysis solved using Cholesky decomposition. The LPC module 21 performs scalar quantization to encode the LPC reflection coefficients The quantized reflection coefficients must be converted to LPC filter coefficients. It is vitally important that the quantized reflection coefficients be used to convert to filter coefficients.

Inputs for the Pole Bandwidth Broadening module 22 come from the LPC module 21 and the Analysis Initialization module, INIT 11. The LPC module provides N LPC filter coefficients stored contiguously starting at ACOEF -1, i.e. al is stored at ACOEF -1, $a_i$ is stored at ACOEF -i. The first coefficient, $a_o$ is always 1.0 and need not be stored. The value stored at ACOEF -0 is a shift factor $\beta$. Each coefficient $a_i$ is actually normalized and is scaled by $2^\beta$. The number N is stored in a location named ORDER which defines , the order of the LPC filter. The last coefficient is, therefore, $a_N$. The pole bandwidth broadening factor is stored in external data memory 30 in a location referenced by the name PBBFAC.

The output of the pole BW module 22 is an array of LPC filter coefficients whose bandwidths have been broadened. The size of the array is the same as the ACOEF array. The name of the array is FC. The module 22 performs a simple multiplication on each of the LPC filter coefficients. The multiplication factor is stored in PBBFAC. It is referred to here as $\beta$. If $a_i$ is an LPC filter coefficient then the broadened LPC filter coefficient $\hat{a}_i$ is given as shown below.

$$\hat{a}_1 = \beta^{i*}ay \; i = 0,1,2,\ldots,N \qquad \text{Equation 2}$$

N is the order of the LPC filter.

Inputs for the Pre-Emphasis Correction module 23 come from the Pole Bandwidth Broadening module 22 and the Analysis Initialization module or INIT 11. The Pole Bandwidth Broadening module 22 provides the broadened LPC filter coefficients in the array FC. There are N filter coefficients stored in FC where N is the LPC filter order as specified by the variable ORDER. FC-k holds $\hat{a}_k$. $a_o$ is always 1.0 and is not stored. Instead, FC -0 holds a number $\beta$ which is the scale factor. That is, the actual value of the broadened LPC filter coefficient stored at FC-k is $2^{\beta}a_k$. The pre-emphasis factor is stored in PREFAC.

The output of the pre-emphasis correction module 23 is an array of LPC filter coefficients which have been corrected for pre-emphasis. The base name of the array is FCPRE. The size of this array is one location larger than the FC array. The format of the FCPRE array is identical to that of the FC array. The module 23 performs the pre-emphasis correction of the broadened LPC filter coefficients. The pre-emphasis factor is $\alpha$. If $a_i$ represents a broadened LPC filter coefficient, then the corrected LPC filter coefficient, $\hat{a}_i$ is given by the pre-emphasis correction on equation below.

$$\hat{a}_i = \alpha_i - \alpha^* \alpha_{i-1} \; i = 1,2,3,\ldots,N \qquad \text{Equation 3}$$

$\hat{a}_o$ is one and $\hat{a}_{N-1}=\alpha^*a_N$. N is the order of the broadened LPC filter.

Inputs for Noise Broadening module 24 come from the Pre-Emphasis Correction module 23 and the Analysis Initialization module 11. The Pre-Emphasis correction module 23 provides N LPC filter coefficients stored contiguously starting at FCPRE, i.e. al is stored at FCPRE -1, $a_i$ is stored at PCPRE -i. The first coefficient, $a_o$ is always 1.0 and need not be stored. A scale factor $\beta$ is stored at location FCPRE-0. The actual filter coefficient is scaled by $2^{62}$ . The number, N is one greater than the LPC filter order which is stored in a location named ORDER. The last coefficient is, therefore, $a_N$. The noise broadening factor is stored in external data memory 30 in a location referenced by the name SSF.

The output of the Noise Broadening module 24 is an array of LPC filter coefficients whose bandwidths have been broadened. The size of the array is the same as the FCPRE array. The name of the array is NSFC. The NSFC array has the same format as the FCPRE array. The module 24 performs a simple multiplication on each of the LPC filter coefficients. The multiplication factor is stored in SSF. It is referred to here as $\beta$. If $a_i$ is an LPC filter coefficient then the noise broadened LPC filter coefficient $\hat{a}_i$ is given as shown below.

$$\hat{a}_i = \beta^{i*}\alpha_i \; i = 0,1,2,\ldots,N \qquad \text{Equation 4}$$

N is one greater than the order of the LPC filter.

Figure 3:
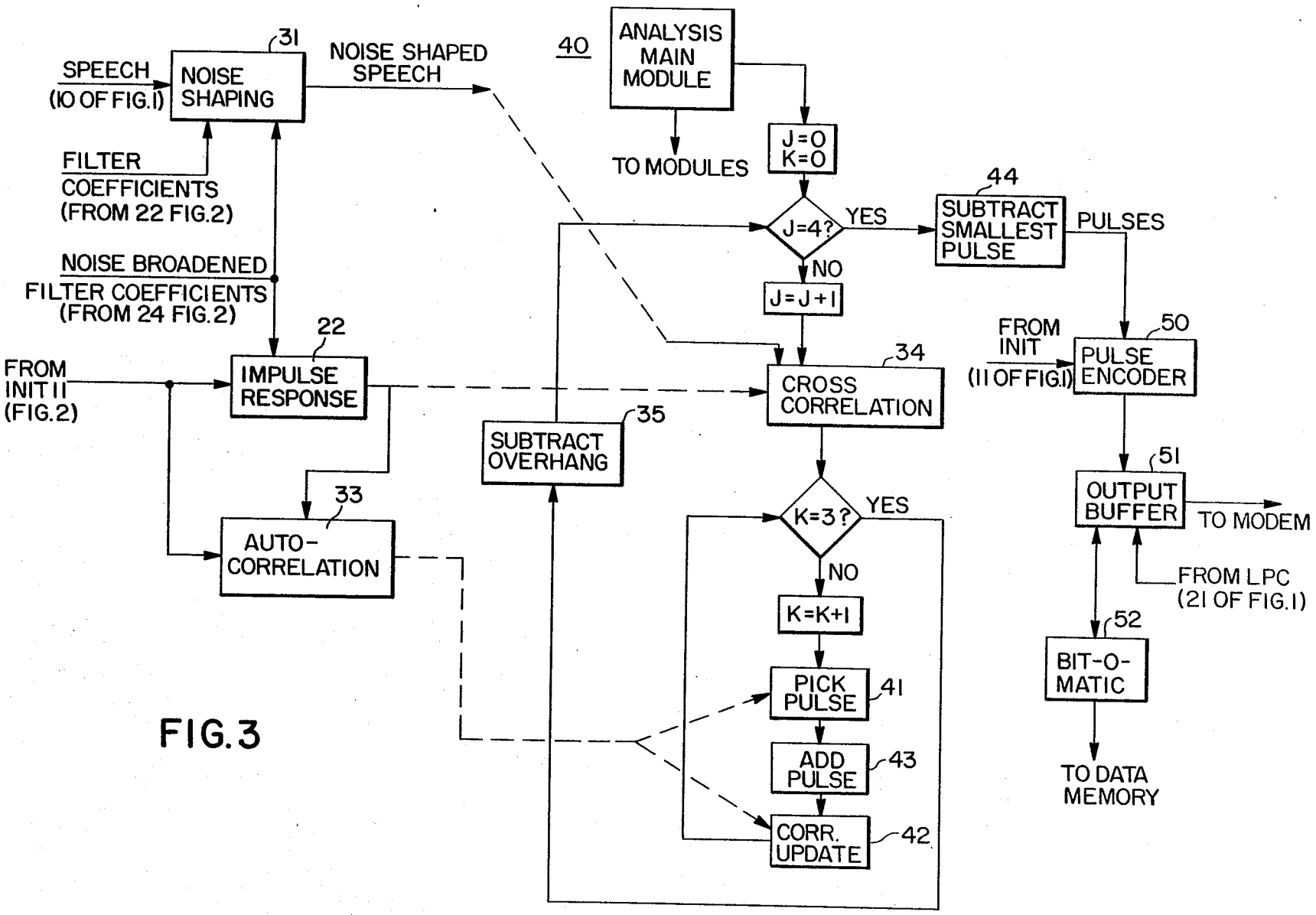
FIG. 3 is a detailed block diagram showing the pulse finding section of the module depicted in FIG. 1.
Figure 4:
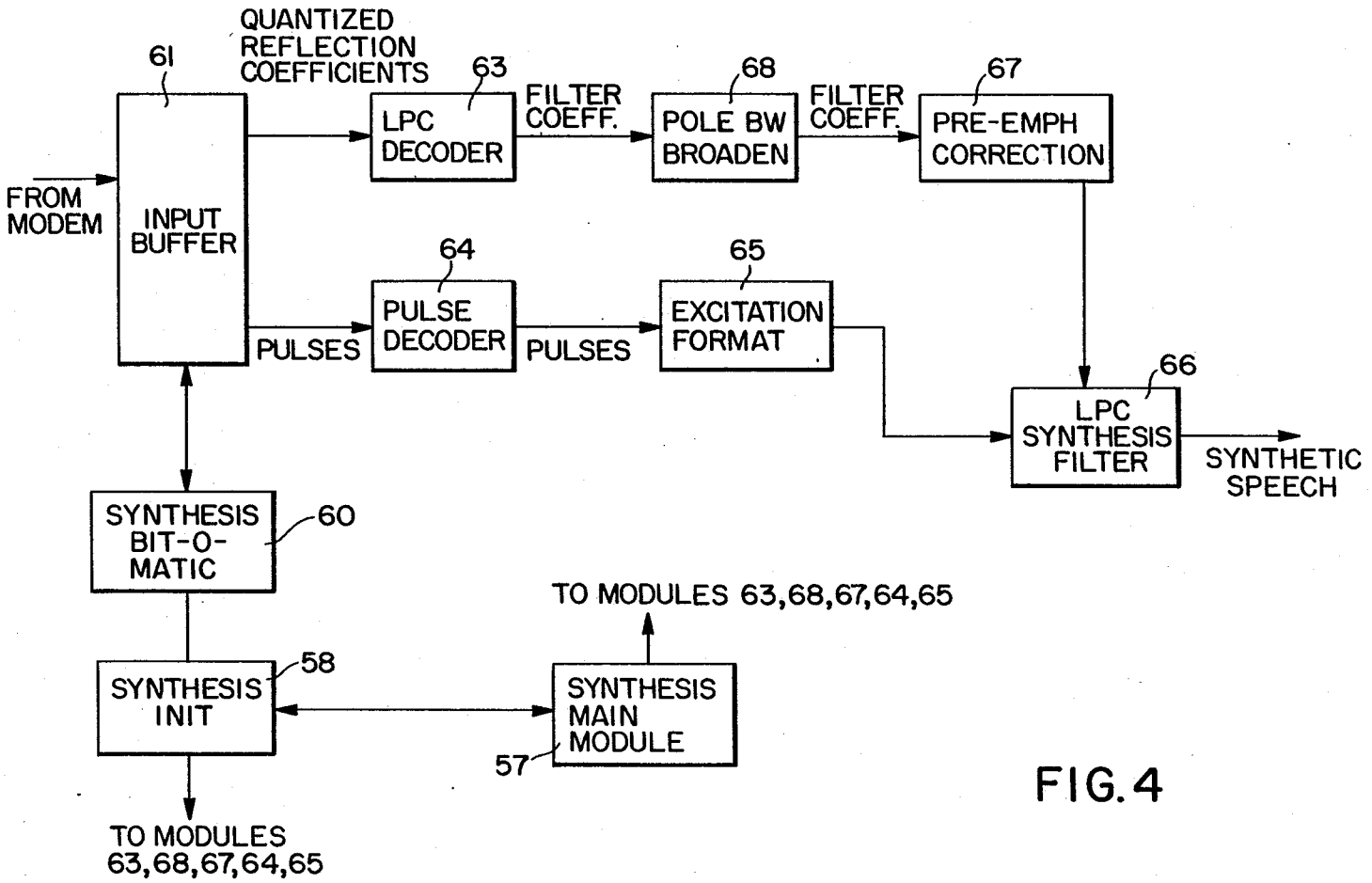
FIG. 4 is a block diagram depicting the receiver or synthesis section of the multi-rate digital voice coder.

Referring to FIG. 3, there is shown a block diagram of additional processing required. Inputs for the Noise Shaping module 31 come from the Pre-Emphasis Correction module 23, the Noise Broadening module 24, the EXEC module 20 and the Analysis Initialization module 11. The EXEC module 20 provides the speech samples to be noise filtered. Most samples are stored in the array referenced by the base name ATODIN. The remaining samples are stored in memory locations immediately and contiguously preceding the ATODIN array. The numerator and denominator filter orders are identical and that order is one greater than the value stored in the variable ORDER provided by the Analysis Initialization module 11. The same module provides the variable LIR which is the length of the impulse response. It also provides the variable FSIZ which is the size of the frame. The Noise Broadening Module 24 provides the noise-shaped filter coefficients NSFC. The Pre-Emphasis Correction Module 23 provides the filter coefficients FCPRE. The noise shaping function consists of a pole-zero filter operation. The FCPRE array contains the numerator coefficients while the NSFC array contains the denominator coefficients.

The noise shaping module 31 is a complex module in the sense that a good deal of address arithmetic takes place. A detailed description of this arithmetic is given. This can be implemented by many well known processor modules as the Texas Instruments TMS 32020 module. See also U.S. Pat. No. 4,641,238 issued on Feb. 3, 1987 to K. N. knieb entitled MULTIPROCESSOR SYSTEM EMPLOYING DYNAMICALLY PROGRAMMABLE PROCESSING ELEMENTS CONTROLLED BY A MASTER PROCESSOR and assigned to the assignee herein.

Since both filters first coefficients are always 1.0 this value is never stored. Instead, the values stored at FCPRE and NSFC are scale factors. That is, each filter coefficient is actually multiplied by $2^{\beta}$where $\beta$ is the appropriate scale factor. Let $n_i$ represent the i -th numerator filter coefficient where i is in the range [l,M]. The value of M is (*ORDER) -1 $n_i$ is stored in FCPRE -i. Let $d_i$ represent the i-th denominator filter coefficient where i is in the range [l,M]di is stored in NSFC -i.

The EXEC module writes speech samples every frame to the array ATODIN. It writes *LFRAME samples beginning at location ATODIN. Samples from the previous frame are stored immediately and contiguously preceding ATODIN. If $x_i$ is the input to the noise shaping filter $y_i$ the output of the filter $n_i$ the i-th numerator coefficient and $d_i$ the i -th denominator coefficient, then $$y_k = x_k + \sum_{i=1}^{M} n_1 x_k - i - \sum_{i=1}^{M} d_i y_{k-i} \qquad \text{Equation 5}$$

For k=0 i.e. the first output value, one requires the input samples from $x_{-m}$ through $x_o$. Hence, by knowing where $x_o$ occurs in the ATODIN array, one can then define the input addressing. $x_o$ does not occur at ATODIN -0 as is known. Rather, $x_o$ occurs at ATODIN -(*ORDER). Therefore, at least ((*ORDER)*2)-1 samples are required from the previous frame to precede the ATODIN array.

The output of the noise shaping module 31 is an array of noise shaped speech samples. The array has the base name DESIG. Its size is *FSIZ plus the value of the variable LIR. DESIG also serves as input to this module since the pole-zero filter requires previous values of its output to calculate the current output as seen from Equation 5.

In this case, at least (*ORDER)-1 samples of the previous output must be placed immediately preceding the DESIG array. The DESIG array is (*FSIZ) (*LIR) samples long. However, the samples which are stored preceding the DESIG array are samples DESIG -(*FSIZ)-(*ORDER)-1 through DESIG -(*FSIZ)-1. The storing of these last (*ORDER)-1 samples is the last thing done before exiting this module.

This module 31 performs the noise shaping on the input speech. The noise shaping filter is a pole-zero filter of the form shown below.

$$\frac{A(z)}{A(\alpha^{-1} z)} \text{ where } A(z) = \sum_{i=0}^{M} a_i z^{-1} \qquad \text{Equation 6}$$

and therefore.

$$A(\alpha^{-1} z) = \sum_{i=0}^{M} a_i \alpha_i z^{-1}$$

If $x_i$ is the input to the noise shaping filter, y' the output of the filter, n' the i-th numerator coefficient and d' the i-th denominator coefficient, then $$y_K = y_K + \sum_{i=1}^{M} n_i y_{k-i} - \sum_{i=1}^{M} d_i K_{y-i} \qquad \text{Equation 7}$$

Obviously, $n_i = a_i$ and $d_i = \alpha^i \alpha_i$

Inputs for the All Pole Impulse Response module 32 come from the Noise Broadening module 24 and the Analysis Initialization module 11. The Noise Broadening module 24 provides the noise shaped filter coefficients in the array NSFC. The size of this array is one larger than the LPC filter order specified by the variable ORDER. The first coefficient is stored in the NSFC array at location NSFC -1 and is $a_1$. $a_o$ is always equal to one and need not be stored. The value stored in NSFC -0 is a shift factor $\beta$. The actual value of the noise-broadened filter coefficient $a_i$ is scaled by $2^{62}$.

The impulse response module 32 provides the impulse response of the noise shaped all pole LPC filter. The length of the impulse response is specified by the variable LIR. The impulse response is stored in an array referenced by the base name IR. The values stored in IR represent normalized values. The actual values are scaled by the shift factor $\nu$. That is, the actual values are multiplied by 2 $\nu$. $\nu$ is stored at a location referenced by the name IRSCL.

The module 32 calculates the impulse response of the noise shaped LPC filter. Careful attention to scaling is necessary to insure enough numerical precision. A C function describing the impulse response calculation is shown below. FUNCTION: Computes the impulse response of the all-pole noise shaping filter.

```
#include <stdio.h>
#include <math.h>
#include mplpc.h
getapir(order,pdfc,lir,pir)
int order,lir;
```

-continued

```
float *pir, *pdfc;
register int n,k,.index:
*pir = 1.0;
for(n=1.n<lir;n - -)
{
    *(pir-n) = 0.0:
    for (k=1:k<=order:k--)
    {
        index = n-k:
        if(index > =0)
            *(pir-n) = *(pdfc-k)*((*pir-index));
        }
    }
}
```

Inputs for the Impulse Response Autocorrelation module 33 come from the All Pole Impulse Response module 32 and the Analysis Initialization module 11.

This module receives the impulse response array IR and calculates the autocorrelation. The length of the IR array is specified by the variable LIR. Associated with the array IR is a scale factor. The values stored in IR represent normalized values. The actual values are scaled by the shift factor ^ . That is, the actual values are multiplied by 2 $\nu$ is store at a location referenced by the name IRSCL.

The autocorrelation module 33 outputs a two-sided autocorrelation array, a one-sided autocorrelation array and a scale factor. The two-sided autocorrelation array is referenced by the base name IRCOR2. The one-sided autocorrelation array is referenced by the base name IRCOR1. The length of the one-sided autocorrelation is specified by the variable LIR. If K is the length of the one-sided autocorrelation then the length of the two-sided autocorrelation is (2*K) -1. If r' is the value of the autocorrelation function for the i-th lag, then r' is stored at IRCORI -i, IRCOR2 -K -1 -i and IRCOR 2 -K -1 -i. Associated with the arrays IRCOR1 and ICOR2 is a scale factor. The values stored in both arrays represent normalized values The actual values are scaled by the shift factor $\beta$. That is, the actual values are multiplied by $2^{\beta}$. $\beta$ is stored at a location referenced by the name CORSCL. CORSCL may be either positive or negative.

The autocorrelation module 33 calculates the autocorrelation of the impulse response of the noise shaped LPC filter. The autocorrelation equation is shown below.

$$r_n = \sum_{i=0}^{N-n} h_i * h_1 + n - n = 0,1,2, \ldots, N \qquad \text{Equation 8}$$

In addition, the data may have to be scaled appropriately to ensure that the finite precision arithmetic of the processor is not compromised. The input scale factor is stored in IRSCL. The output scale factor is to be stored in CORSCL.

Inputs for the Cross Correlation module 34 come from the Noise Shaping module 31, the All Pole Impulse Response module 32, the Analysis Main module 40, the Overhang module 35 and the Analysis Initialization module 11. The Noise-Shaping module 31 provides noise shaped speech samples in an array referenced by the base name IR and by the scale factor IRSCL. The size of the IR array is given by the variable LIR. The size of the DESIG array is the value of the variable FSIZ plus the value of the variable LIR. The relative sample location in the DESIG array to start the cross correlation is given in the variable PTRDES. PTRDES is set in the Analysis Main module 40.

The Overhang module 35 provides an array of samples which are the result of the synthesis filter ring down. The array is referenced by the base name OVR. Its size is the value of the variable BLKSIZ plus the value of the variable LIR.

The output from the cross correlation module 34 are two arrays of BLKSIZ samples each. They are referenced by the base names XCOR1 and XCOR2. The module 34 performs the cross correlation between the noise shaped speech and the impulse response of the noise shaped synthesis filter.

The first calculation to perform is to subtract the samples in the OVR array from the noise shaped speech samples. The result is be placed in a local array. For the sake of explanation; let's call the difference $w^n$. The number of samples in the difference array is N. The number of samples in the impulse response is M. The impulse response is denoted by $h_n$. If the cross correlation is $\theta_n$, then $$\theta n = \sum_{k=0}^{M-1} h_k w_n + K \; n = 0, 1, 2, \ldots, L-1 \qquad \text{Equation 9}$$

L is the value of the variable BLKSIZ.

Inputs for the Pick Pulse module 41 come from the Cross Correlation module 34 the Correlation Update module 42, the Impulse Response Autocorrelation module 33, the Analysis Main module 40 and the Analysis Initialization module 11. The Cross Correlation module 34 and the Correlation Update module 42 provide a cross correlation array referenced by the base name XCOR2. The Impulse Response Autocorrelation module 33 provides an array referenced by the base name IRCOR1 and a variable referenced by the name CORSCL. The value stored in CORSCL is a scale factor used to adjust the IRCOR1 array values. The Analysis Initialization module 11 provides the variables NPULSE and BLKSIZ. The Analysis Main module 40 provides the variable PCNTR.

The output of this pick pulse module 41 is a pulse location and amplitude. The amplitude is stored in the variable PAMP while the location is stored in the variable PLOC. The module 41 performs the search for the maximum cross correlation term and then determines the location and amplitude of the next MPLPC pulse. It searches the cross correlation array XCOR2 for the largest magnitude pulse. The size of the array is contained in the variable BLKSIZ. The location of the MPLPC pulse is the same as that of the largest magnitude cross correlation pulse, i.e., in the range [O,BLKSIZ-1.]

The amplitude of the MPLPC pulse is the value (negative or positive) of the largest cross-correlation value divided by the value of the impulse response autocorrelation value at lag 0. The impulse response autocorrelation value at lag 0 has to be scaled appropriately by *CORSCL. An LPC frame is 192 samples long. For each block, currently three MPLPC pulses are found. The locations of the first two pulses in a block are not constrained. The location of the last pulse in a block is constrained due to quantization constraints. The third pulse must be located no further than 24 locations from any other pulse in the block. Also at least one of the pulses must occur in one of the first 25 locations in the block. The burden of these constraints is placed on the third pulse. Therefore, the search for the third pulse must be constrained to lie in the range so defined by the above two constraints.

The variables PULSE and PCNTR are provided so that the user may determine when the constraints must be applied. Whenever the value of PCNTR plus the number 1 is divisible in whole by the value of NPULSE, then the constraints must be applied. For example the value of PCNTR is 0 when the initial pulse is found. Since NPULSE is 3, (0+1)/3 is not an integer so the constraints are not applied. When PCNTR is 1, the second pulse is found. (1+1)/3 is not an integer so the constraints are not applied. However, when PCNTR is 2, the third pulse is found and (2+1)/3 is an integer and the constraints are applied.

Inputs for the Add Pulse module 43 come from the Pick Pulse module 41 and the Analysis Initialization module 11. The Pick Pulse module 41 provides a pulse location and amplitude. The amplitude is stored in the variable PAMP while the location is stored in the variable PLOC. The Analysis Initialization module 11 provides the variable NBLK (the number of blocks per LPC frame). The Analysis Main module 40 provides a pulse counter variable termed PCNTR.

The outputs from the Add Pulse module 43 are two arrays of pulse information. The two arrays contain pulse amplitude and location information. The location array is referenced by the base name PLSLOC. The amplitude array is referenced by the base name PLSAMP. This module simply stores the value of PAMP and PLOC in the appropriate array at an offset given by the variable PCNTR. It does not update PCNTR. The module 43 simply moves pulse amplitude information from one location in memory to another. It performs the identical operation with the pulse location information. Inputs for the Correlation Update module 42 come from the Pick Pulse module 41, the Impulse Response Autocorrelation module 33 and the Analysis Initialization module 11. The effect on the noise shaped speech signal due to the last pulse found is removed in this module. The Pick Pulse module 41 provides the last pulse found through the information contained in PAMP and PLOC; the pulse amplitude and pulse location, respectively. The Pick Pulse module 41 indirectly provides the cross correlation array XCOR2. The size of the XCOR2 array is given by the variable BLKS effect of the last pulse will be subtracted from this array. The Impulse Response Autocorrelation module 33 provides two arrays, IRCORI and IRCOR2 as well as their associated scale factor CORSCL. IRCOR1 is the one-sided impulse response autocorrelation array while IRCOR2 is the two-sided impulse response autocorrelation array. The values stored in both IRCORI and IRCOR2 represent normalized values. The actual values are scaled by the shift factor *CORSCL. That is, the actual values are multiplied by 2*CORSCL.

The output of the module 42 is the updated XCOR2 array. The correlation update module scales the two-sided impulse response autocorrelation by the value of the new pulse amplitude, shifts it to the position dictated by the new pulse location, and then subtracts it from the cross correlation array. The result is an updated cross correlation array. C function follows to aid in the description of this module. Function: After the next pulse has been chosen for the multipulse analysis, the cross correlation array is updated by subtracting form the old cross-correlation array, the shifted and scaled autocorrelation array. This procedure laces a zero amplitude pulse at the location in the cross-correlation array where the largest (magnitude) pulse stood before.

```
#include <stdio.h>
#include <math.h>
#include mplipc.h
updcor(npts.pacor.pxcor.oploc.opamp)
int npts.oploc:
float *pacor.=pxcor.opamp;
{
        int j.k:
        for(k=0:k<npts:k--)
        {
            j = abs(k-oploc);
            *(pxcor-k) = *(pacor-j)*opamp:
        }
}
```

Inputs for the Overhang Calculation module 35 come from the Impulse Response module 32, the Analysis Initialization module 4 and the Analysis Main module 40.

The Impulse Response module 32 provided the impulse response array IR and its associated shift factor IRSCL. The length of this array is given by the value of the variable LIR. The values stored in IR represent normalized values. The actual values are scaled by the shift factor $\nu$. That is, the actual values are multiplied by $2^{\nu}$. $\nu$ is stored at a location referenced by the name IRSCL. The Analysis Initialization module 11 provides the variable NPULSE (the number of pulses per block). The Analysis Main module 40 provides the variable PCNTR (a pulse counter) and the two arrays PLSLOC and PLSAMP. PLSLOC contains pulse location information. PLSAMP contains pulse amplitude information.

The output of the overhang module 35 is the array OVR which is stored in the external data memory 30. The size of this array is the sum of the values of the variables LIR and BLKSIZ.

The overhang module 35 must calculate the multi-pulse-excited noise-weighted filter response which lies in the next speech block. It only concerns itself with the part of the response which overhangs into the following block of speech. It is assumed that the length of impulse response due to any one pulse is finite and has the value specified by the variable LIR (length of impulse response). Function: This function computes the overlap between frames (or blocks) of speech. This is necessary since some pulses may occur near the end of a previous frame (block) and the filter response due to those pulses is significant and must be considered in the next frame (block).

```
#include <stdio.h>
#include <math.h>
#include mplpc.h
#define MAXQ 256
compovr(npts.npulse.ppulse.lir.pir.povr)
int npts.npulse.lir:
float *pir.*povrL
RPUKSE *ppulse:
{
    register int j.k:
    int iovr.oploc:
    float opamp:
    for(k=0:k<MaxQ:K--)
    *(povr-k) =0.0
    {
        oploc = ppulse>loc j;
        opamp = ppulse>amp j
        for(k=0:k,lir:k--)
```

-continued

```
    {
    iovr = k -oploc-npts;
    if(iovr > =0)
                    *(povr - iovr) -
                    =*(pir-k)*opamp:
```

Inputs for the Subtract Pulse module 44 come from the Analysis Main module 40 and the Analysis Initialization module 11. The Analysis Main module 40 provides two arrays of pulse information, PLSLOC and PLSAMP. The number of pulses in each array is given by multiplying the value of the variable NBLK with that of NPULSE.

The output of this module 44 consists of the two arrays mentioned above. The smallest amplitude pulse in the first half of the PLSAMP array is found and set to zero. The corresponding location in the PLSLOC array is set to -1. The module 41 finds the lowest magnitude pulse in the first half of pulse amplitude array and sets it to zero. It finds the corresponding location in the pulse location array and sets it to -1.

Inputs for the pulse encoder module 50 come from the Subtract Pulse module 44 and the Analysis Initialization module 11. The Subtract Pulse module 44 provides two arrays, PLSAMP and PLSLOC, whose size is N. N is the result of multiplying the values of the variables NPULSE and NBLK. The PLSAMP array contains the pulse amplitude information while the PLSLOC array contains the pulse location information. The Analysis Initialization module 11 provides the variables NBLK and NPULSE, the number of MPLPC blocks per frame and the number of pulses per block.

The output of the pulse encoder module 50 is an N -1 word buffer containing pulse amplitude and location information. The buffer is referenced by the base name PBUF. This module must also output the variable MAXAMP, SBINFO and PLSFIX. MAXAMP is a six-bit word whose value is the quantized gain. SBINFO is a one-bit word whose value indicates which of the first two MPLPC blocks contains only 2 MPLPC pulses. PLSFIX is a two-bit word whose value indicates whether the "short" block needs to have its pulses "fixed".

The encoder 50 is responsible for all the MPLPC quantization except for the spectral quantization. Pulses are passed to this module in two arrays. Amplitudes are passed in one array while locations are passed in the other. It should be assumed that the MPLPC frame is broken into four blocks of *BLKSIZ samples each and that each block contains three MPLPC pulses.

The maximum pulse amplitude is found and quantized using a six-bit quantizer. The quantizer is assumed to be provided in the form of a table of codewords of increasing order. The quantizer codes the magnitude of the largest pulse i.e. the codewords are all non-negative.

The magnitudes of all remaining pulses are to be scaled by the quantized maximum pulse and then quantized using a 10 word quantizer. This quantizer must account for the sign of the pulse amplitude and shall be given in the same form as the gain quantizer described above.

There are twelve pulses which are passed to this module as stated above. The first three pulses represent pulses from the first MPLPC block. The second three pulses represent pulses from the second MPLPC block and so on. The MPLPC block which will eventually contain only two pulses is the block which has a pulse location of minus one. The value of SBINFO is given the value j if block j has only two pulses. j can take the value 0 or 1.

The pulse fixing information is needed because the deleted pulse may have been in a position necessary for location quantization. If by deleting the pulse one satisfies the constraints imposed as specified in the Pick Pulse module 41 then the value of PLSFIX is zero. If the deleted pulse was the only pulse (among the three in the block) whose location was among the first 25 locations in the block then the value of PLSFIX is one. If the deleted pulse was such that its location was between the other two pulses and that by deleting it the other two pulses are now more than 24 locations apart then the value of PLSFIX is two.

The pulse amplitudes and locations are used in a product code as follows. Recall that the pulse amplitudes are coded using a ten level quantizer, i.e., its value is in the range [0,9]. Pulse locations are encoded differentially except for the first pulse in each block. The first pulse is encoded absolutely. The constraints of the Pick Pulse module 41 have ensured that all location differences will be in the range [0,24]except a pulse is deleted. The MPLPC block with a deleted pulse will be discussed separately. In a "normal" MPLPC block the pulse amplitude code is multiplied by 25 and added to the pulse differential code. An example should be sufficient. Assume the three pulse amplitude codes in a block are 2, 5 and 9. Also assume their absolute locations are 13, 25 and 44 (they must be order). The product codes resulting from these pulses are 63 (2×25-13), 137 (5×25-25-13) and 244 (9×25 - 44-25).

In the case of a two-pulse block, the value of PLSFIX must be examined If PLSFIX equals zero, the product code is formed as above using two pulses instead of three. If PLSFIX equals one. One first subtracts the value 25 from the two pulse locations and then perform the procedure above. If PLSFIX equals two, to subtract the value 25 from the second pulse location only and then perform the procedure above.

Inputs for the output buffer module 51 all come from the Pulse Quantizer or encoder module 50 and the LPC module 21. The LPC module 21 provides the quantized reflection coefficients from the LPC analysis. The quantized reflection coefficient information requires forty-one bits. The quantized reflection coefficients are stored in a buffer referenced by the base name QRC. There are ten reflection coefficients: $k_1$ through $k_{10}$. The reflection coefficients are stored contiguously in memory with $k_1$ stored in the location referenced by QRC and $K_{10}$ stored in the location referenced by QRC -9. Each coefficient is stored as a single word although not all sixteen bits of each word are significant. Only the least significant portion of each word is significant. The bits used for each reflection coefficient are as follows: five bits for $k_1$ through $k_4$ four bits for $k_5$ through $k_8$, 3 bits for $k_9$ and two bits for $k_{10}$.

The pulse quantizer 50 provides information on the pulse amplitude and locations. The output of the pulse encoder module 50 is a fixed length buffer containing quantized pulse information. Each word in the PBUF array represents a unique eight bit pulse word. The buffer is referenced by the base name PBUF. Location NUMPLS contains the number of pulses to be found in PBUF. The Pulse Quantizer module of encoder 50 also provides information on pulse gain. This information is stored as a seven bit word in a location named MAXAMP. In addition, two other important parameters, SBINFO (short block info) and PLSFIX (pulse location fix) are provided by the Pulse Quantizer 50 SBINFO contains a two bit word PLSFIX a one bit word.

The output from the buffer module 51 is a fixed length bit stream which is written to a circular queue whose size is QSIZE/16 6-bit words and whose base name is QBASE. QSIZE is an externally EQU-ed constant which is set to 102A. Associated with the queue are two pointers; QHEAD and QTAIL. Both are single 16-bit words. QHEAD points to the next available location (bit) which will be read for the output queue. Both QHEAD and QTAIL are in the range 0, QSIZE -1. Obviously, both are offset from the base address location of the queue. The base address is a word address; not a bit address. Each frame written to the queue contains 138 bits of MPLPC information. The bit map is shown below.

| BITS | INFORMATION |
|---|---|
| 0–4 | $k_1$ |
| 5–9 | $k_2$ |
| 10–14 | $k_3$ |
| 15–19 | $k_4$ |
| 20–23 | $k_5$ |
| 24–27 | $k_6$ |
| 28–31 | $k_7$ |
| 32–35 | $k_8$ |
| 36–38 | $k_9$ |
| 39–40 | $k_{10}$ |
| 41 | SBINFO |
| 42–43 | PLSFIX |
| 44–137 | PBUF |
| 132–137 | MAXAMP |

A blinking synchronization bit is placed on the queue every 414 bits, i.e. every three frames. The synch bit robs a bit from the gain information every three frames. The synch bit is the last bit placed on the queue preceded by a five bit gain word. The synh bit is actually placed in the most significant bit of the last six-bit word of the frame because the parallel to serial conversion is done LSB to MSB. When no synch bit is required, the remaining two frames, gain is a six bit word.

This module must maintain the two queue pointers, QHEAD and QTAIL; insuring that one does not run over the other and that QHEAD is updated correctly.

The last logical bit placed on the output queue is a blinking synchronization bit. Every 414 bits thereafter ad infinitum a synchronization bit is placed on the output queue. Since this is a fixed rate system each frame writes 138 bits of MPLPC information to the output queue. Therefore, a synch bit occurs exactly once very three frames as the last logical bit in the frame.

The last MPLPC information placed on the output queue is the gain. Gain is quantized to six bits. IF a synch bit is needed for the frame, gain can occupy only five bits. Regardless, gain is passed to this module as a six bit quantity whose high order ten bits are meaningless. These ten bits should be masked to zero. The six bits are placed directly on the queue. The most significant bit of the six-bit word is used for "synch" information every three frames. The six-bit gain word is shifted right once to make room for the "synch" bit. When a synch bit is needed, the least significant bit of the gain information is discarded. The next five bits are used. That is, if bits 0–5 contain the six bits of gain information then bits 6–15 are masked, bit 0 is discarded and bits 1–5 are placed on the output queue.

The ten quantized reflection coefficients are the first bits placed on the output queue. This information consumes 41 bits. The short block information is then placed on the output queue. This is a one bit quantity. The pulse fixing information is then placed on the output queue. This is a two bit quantity. The eleven MPLPC pulses are then placed on the output queue. Each pulse is specified by eight bits. A total of 88 bits of pulse information is output. All information to be placed on the output queue i masked before processed Inputs for the analysis Bit-0-Matic module 52 come from the Output Buffer module 51. The input to this module 52 is a fixed length bit stream which is written to a circular queue whose size is QSIZE 16 16-bit words and whose name is QBASE. QSIXZE is an externally EQU-ed constant which is set to 102A. Associated with the queue are two pointers; QHEAD and QTAIL. Both are single 16-bit words. QHEAD points to the next available location (bit) on the output queue which may be written to. QTAIL points to the next available location (bit) which will be read from the output queue. Both QHEAD and QTAIL are in the range [0 QSIZE -1]. Obviously both are offset from the base address location of the queue. The base address is a word address; not a bit address. This module must maintain QHEAD and QTAIL; insuring that one does not run over the other. It must also update QTAIL appropriately. This module 52 also receives as input a single 16-bit word whose value is the number of packets which must be output. This word is referenced by the name NMPRTS. Each packet contains six bits of MPLPC information and two bits Modem formatting.

Output from the module 52 is written to two contiguous arrays in shared memory. Unlike the rest of external data memory which is 16 bits wide shared memory is only 8 bits wide. The first array is referenced by the base name SDINDl and the second array is referenced by the base name SDIDlE. The arrays are written to by adding an offset to the base name of the array and writing to the location so defined. This relative offset is in the range oo0.SDIDIE=SDINDl-1. Currently, this range is 0.127. The value SDIDlE=SDINDl is EQU-ed externally and given the name DATBSZ i.e. DATBSZ 128 presently. The array offset is referenced by the name SDIDIX and is a word address. SDIDlX initially points to the next writable location in the SDINDl array; the first array. It must be correctly updated as information is placed in shared memory.

The module 52 must read bits from the output queue six at a time. Every six bits read from the output queue is prepended with two zeros to form an eight-bit word. This byte is then written to shared memory. The module must read NMPKTS to determine how many eight-bit words (packets) are written to shared memory. The implementation of the NMPKTS employs a value of 23 as for example. In addition, the module must maintain write and read pointers for the output queue and the shared memory array; checking wrap around conditions on both queues.

Input for the synthesis Bit-O-Matic module 60 comes from the modem, i.e. shared memory. This information is stored in shared memory via an array referenced by the base name SDOUD2. A relative offset (index, pointer) is used to access information in this array. This offset is given the name SDOD2X-1, i.e. the second word of the two word array SDOD2X. SDOD2X-1 points to the next readable location in the SDOUD2 array. The size of this array is defined by the externally EQU-ed constant DATBSZ. When reading from this array, it is permissible to read data at and beyond location SDOUD2-DATBSZ since the array is reproduced starting at that location, i.e. the value at SDOUD2+k equal the value at SDOUD2-DATBSZ-k for k in the range 0.DATBSZ-1.

The first nine locations in the SDOUD2 array are not guaranteed to be valid. Therefore, if the pointer is pointing in this range, the second array should be read for the correct information. In all cases, N packets are read from this input array and placed in the input queue. The variable N is stored at the location referenced by the name NMPKTS.

Data is written to a circular queue whose size is QSIZE 16 16-bit words and whose base name is QBASE. QSIZE is an externally EQU-ed constant which is set to 1024. Associated with the queue are two pointers; QHEAD and QTAIL. Both are single 16-bit bit words. QHEAD points to the next available location (bit) on the input queue which may be written to. QTAIL points to the next location (bit) which will be read from the input queue. Both QHEAD and QTAIL are in the range 0QSIZE-1. Obviously, both are offset from the base address location of the queue. The base address is a word address; not a bit address. This module must maintain QHEAD and QTAIL; insuring that one does not run over the other. It must also update QHEAD appropriately.

The module 60 must read bits from the shared memory eight at a time. Every eight bits read from shared memory is stripped of the two leading zeroes to form a 6-bit word. This word is then written to the input queue. The module 60 must read N 8-bit words (packets) for each MPLPC frame. N is the number of packets as specified by the variable NMPKTS. In addition, the module must maintain write and read pointers for the input queue and the shared memory array; checking wrap-around conditions on both.

Inputs for the Input Buffer module 61 all come from the synthesis Bit-o-Matic module 60. Input data is written to a circular queue whose size is QSIZE 16 16-bit words and whose base name is QBASE. QSIZE is an externally EQU-ed constant which is set to 1024. Associated with the queue are two pointers; QHEAD and QTAIL. Both are single 16-bit words. QHEAD points to the next available location (bit) on the input queue which may be written to. QTAIL points to the next location (bit) which will be read from the input queue. Both QHEAD and QTAIL are in the range (0 QSIZE-1). Obviously, both are offset from the base address location of the queue. The base address is a word address; not a bit address.

The buffer module 62 must check for synchronization information at all times. A blinking synchronization bit appears every 414 bits and is simply discarded.

Since this is a fixed rate system, every 138 bits represents a frame of MPLCPC information. When a synch bit is the start of a new MPLPC frame, i.e. the synch bit is the last logical bit in a MPLPC frame. It is the most significant bit of the last 6-bit word in a MPLPC frame. The other five bits in the word represent the gain term in the old MPLPC frame. When no synch bit is present, gain is a 6-bit word. The 6-bit gain word is placed in external data memory referenced by the name MAXAMP. The 5-bit gain word is shifted left one bit and placed in MAXAMP A zero is shifted in the least significant bit of MAXAMP.

The next 41 bits represent the quantized reflection coefficients for the next frame. The Output Buffer module describes the format of this information. This information is placed in external memory referenced by the name QRC.

The next bit represents the short block information. This bit is placed in external memory referenced by the name SBINFO.

The next bits are the MPLPC pulse fixing information. They are placed in external memory referenced by the name PLSFIX.

The next 88 bits represent the 11 MPLPC pulses. Each pulse is specified by eight bits. The 11 pulses are stored contiguously in external memory starting at location PBUF. The high order bits of all variables are masked before the variables are placed in the external data memory.

Input data is written to a circular queue whose size is QSIZE/16 16-bit words. The module 61 must read 138 bits from the queue to define a frame of speech.

The input buffer module 61 has to account for the blinking synchronization bit which occurs every 414 bits on the input queue. The synchronization bit is the last logical bit in a frame which is placed on the input queue after startup or resynchronization. Since this is a fixed rate system, the synch bit occurs as the last logical bit in a MPLPC frame every third frame.

Immediately following the blinking synchronization bit is the 5-bit word which defines the gain information for the current frame. With MPLPC frames not containing synch information, the gain word is six bits long. The 6-bit gain word is ready for placement in data memory. A 5-bit gain word must be multiplied by two before being placed in data memory. The current frame's gain word is followed by 10 words of quantized reflection coefficients (41 bits) from the next frame, a 1-bit short block info word, a 2-bit pulse fixing word and 88 bits of pulse information. There are 11 pulses, eight bits per pulse.

The input to the LPC Decoder module 63 is an array of quantized reflection coefficients. The quantized reflection coefficient information requires forty-one bits. The quantized reflection coefficients are stored in a buffer referenced by the base name QRC. There are ten reflection coefficients; $k_1$ through $k_{10}$. The reflection coefficients are stored contiguously in memory with $k_1$ stored in the location referenced by QRC and $k_{10}$ stored in the location referenced by QRC-9. Each coefficient is stored as a single word although not all 16 bits of each word are significant. Only the least significant portion of each word is significant. The bits used for each reflection coefficient are as follows: five bits for $k_1$ through $k_4$, four bits for $k_5$ through $k_8$, three bits for $k_9$ and 2 bits for $k_{10}$.

The LPC Decoder module 63 provides N LPC coefficients stored contiguously starting at ACOEF-1. i.e. $a_1$ is stored at ACOEF-1, $a_i$ is stored at ACOEF -i. The first coefficient $a_0$ is always 1.0 and need not be stored. The value stored at ACOEF+0 is a shift factor $\beta$. Each coefficient $a_i$ is actually normalized and should be scaled by $2^{\beta}$. The number N is stored in a location named ORDER, the order of the LPC filter. The last coefficient is, therefore, $a_N$.

The LPC Decoder module 63 must perform the decoding of the 41-bit LPC reflection coefficient information. It must also transform the reflection coefficients into LPC filter coefficients. The filter coefficient array must be stored as scale factor and scaled coefficients.

Inputs for the pulse decoder module 64 all come from the input buffer module 61. The input to the pulse decoder module is a fixed length buffer containing pulse amplitude and location information. The buffer is referenced by the base name PBUF. The length of the buffer is N words where N is the result of multiplying the values of the variables NPULSE and NBLK.

Other inputs to this module include the short block information SBINFO, the pulse fixing information PISFIX, and the quantized gain MAXAMP.

The output consists of two arrays of N words each referenced by the names PLSLOC and PLSAMP. The PLSLOC array contains the locations-within each MPLPC block- of the pulses whose amplitude is stored in the PLSAMP array.

The pulse decoder 64 is the inverse of the pulse encoder 50 and the functional s understood clearly from the description of the encoder.

Inputs for the excitation format module 65 come from the pulse decoder module 64 and the synthesis initialization module 58.

The Pulse Decoder module 64 provides two arrays of pulse information. The pulse amplitude information is stored in any array referenced by the base name PLSAMp. The pulse location information is stored in an array referenced by the base name PLSLOC.

The Synthesis Initialization module 58 provides the variable NBLK, BLKSIZ and NPULSE. NBLK specifies the number of blocks each LPC frame is segmented into. NPULSE specifies the number of pulses each block contains. Together they specify the number of pulses in each frame. BLKSIZ specifies the number of samples in each block.

The module 65 provides an array as the only output. The array is referenced by the base name EXCBUF. The pulses specified by PLSAMP and PLSLOC are placed in the EXCBUF array and the remaining locations in EXCBUF are zeroed.

The excitation buffer of module 65 should be zeroed each time this module is entered. In all, 193 locations should be zeroed. The amplitudes of the excitation pulses are stored in PLSAMP and are transferred directly into the excitation buffer as specified by the location information.

Each MPLPC frame is broken into NBLK blocks of BLKSIZ samples. In each block, NPULSE pulses are found. The typical values of the three variables are shown below.

| | |
|---|---|
| NBLK | 4 |
| BLKSIZ | 48 |
| NPULSE | 3 |

The location information is stored differentially from the beginning of each block, i.e. if the PLSAMP and PLSLOC array are as follows, then the EXCBUF array will appear as shown below.

| | | | | | | | | | | | | |
|---|---|---|---|---|---|---|---|---|---|---|---|---|
| PLSAMP | 100 | 200 | 300 | 125 | 0 | 325 | 150 | 250 | 350 | 175 | 275 | 375 |
| PLSLOC | 3 | 17 | 10 | 43 | 0 | 19 | 12 | 13 | 14 | 29 | 0 | 29 |

EXCBUF (3) = 100 EXCBUF (10) = 300 EXCBUF (71) = 200

-continued

| | | |
|---|---|---|
| EXCBUF (57) = 0 | EXCBUF (67) = 325 | EXBUF (91) = 125 |
| EXCBUF (108) = 150 | EXCBUF (109) = 250 | EXCBUF (110) = 350 |
| EXCBUF (144) = 275 | EXCBUF (173) = 550 | |

All other values of EXCBUF are zero. Note that it is possible for two locations to be identical. In this case their amplitudes must be summed to arrive at the correct amplitude for that location.

Inputs for the LPC synthesis filter module 66 come from the pre-emphasis correction module 67, the excitation format module 65, the synthesis initialization module 58 and the synthesis main module 57.

The Pre-Emphasis Correction module 67 provides an array of LPC filter coefficients referenced by the base name FCPRE. There are N filter coefficients stored in FCPRE where N is one greater than the LPC filter order as specified by the variable ORDER. FCPRE-k holds $a_k$. $a_o$ is always 1.0 and is not stored. Instead, FCPRE -0 holds a number, $\beta$ which is the scale factor. That is, the actual value of the LPC filter coefficient stored at FCPRE-k is $2^{\beta}a_k$.

The excitation format module 65 produces an array of excitation pulses referenced by the base name EXCBUF. The size of the EXCBUF is stored in the variable LFRAME provided by the synthesis main module 57.

The Synthesis Initialization module provides the following variables:

| | |
|---|---|
| ORDER | The order of the LPC filter before pre-emphasis correction. |
| FSIZ | The size of the nominal LPC frame. |
| NBLK | The number of blocks per LPC frame. |
| NPULSE | The number of MPLPC pulses per block. |

The Synthesis Main module provides the variable LFRAME which indicates the number of samples to synthesize. This number may be 191, 192 or 193.

The output of the synthesizer 66 is a circular queue filled with synthetic speech. The size of the queue is currently 1024 samples. The size of the queue is externally EQU-ed with the label OBUFL: the current value of OBUFL being 1024. Each frame 191, 192 or 193 samples are written to the queue. Associated with the queue is a write index, i.e. pointer, offset, etc. which is in the range 0.1023. The queue index is an offset from the base address of the queue and points to the next writable location on the queue. The base address of the queue is referenced by the name OBUFF. The queue index is referenced by the name OBUTFI. Therefore, the next writable location on the queue is OBUFF-OFUFI. The LPC synthesis module 66 is responsible for updating OBUFI as it fills the queue. The format of the samples placed on the queue is that of 8-bit mu-law-companded speech samples. The eights are placed in the least significant portion of each 16-bit word.

The LPC filter module 66 reads the excitation buffer in module 65 and passes the excitation samples through the synthesis filter. The synthesis will produce either 191, 192 or 193 samples. Following synthesis, the samples must be transformed using a linear-to-mu-law compander and written to the circular output queue.

In regard to the above-noted discussion, each and every function of each individual module has been given. It is, of course, understood that the modules can be configured in hardware configurations such as employing memory, shift registers and various other devices which are commercially available. In any event, one can implement the various functions by use of a typical digital signal processor such as the integrated circuit sold and manufactured by the Texas Instruments Corp. designated as the TMS-32020. This processor can be programmed to perform the above-described functions including linear predictive coding analysis and the various other functions as described above.

The processor can work with external memories as well as internal memories The processor as the TMS-32020 contains an internal memory which is capable of handling most of the storage function as indicated above. Thus, according to the above description, one has received a detailed analysis of all inputs furnished to each of the modules, the nature of all outputs furnished by each of the modules as well as the functions to be preformed in each and every module. It is indicated that due to the nature of the above system the bit rate as well as the output rate emanating from the output buffer can be varied according to the above-described programmable technique.

Variation of bit rate is implemented by the number of bits utilized to output the stored and processed digital data. These bit numbers can be modified and changed according to the transmission requirements of a particular channel. The bit rate is essentially independent of the processing which is done. Therefore, when particular bits or bit rates were indicated above, they were given by way of example. It should be understood by one skilled in the art that both the bit format and bit rate can be modified by modifying the separate programs which control each of the modules. In this manner, the number of bits as well as the outputted bit rate can be modified by simple program changes in each of the above-described modules.

As indicated above, the 16-bit words can be replaced by 8-bit words and so on. It is, therefore, considered that the modification of the above-described programs in regard to each of the functions of the modules as described above can be modified to accommodate variable bit rate as well as different bit lengths for each of the process signals.

What is claimed is:

1. Apparatus for converting analog speech into a digital signal for transmission of said digital signal over a conventional communications channel, comprising:

pre-emphasis means responsive to said analog speech at an input for providing at an output an array of pre-emphasized speech samples, memory means coupled to said pre-emphasis means for storing said array of samples in contiguous storage locations, linear predictive coder means coupled to the output of said memory means and responsive to said stored samples for providing a first array of reflection coefficients at a first output and a second array of filter coefficients at a second output, pole broadening means coupled to said linear predictive coder means and responsive to said filter coefficient array for providing an array of filter coefficients having a broadened bandwidth including means for multiplying each of said filter coefficients in said array by a given factor, a pre-emphasis correction means coupled to said pole broadening means for receiving at an input said array of broadened bandwidth filter coefficients for providing at an output an array of corrected filter coefficients, pulse processing means coupled to said pre-emphasis means and said pre-emphasis correction means and responsive to said pre-emphasis speech samples and said corrected filter coefficients for providing at a first output a first series of pulses indicative of pulse amplitude and at a second output a second series of pulses indicative of pulse location, encoder means coupled to said first and second outputs of said pulse processing means for providing a stream of pulses indicative of a product code of said first and second series of pulses, and output buffer means having a first input coupled to said first output of said linear predictive coding means for receiving said reflection coefficients and a second input coupled to said encoder means for receiving said stream of pulses for providing at an output a digital signal of a given length bit stream having a bit rate determined according to said communications channel.

2. The apparatus according to claim 1, further including:

a noise broadening means between said pre-emphasis correction means and said pulse processing means, said noise broadening means responsive to said corrected filter coefficients and including multiplier means for multiplying each corrected filter coefficient by a given multiplication factor and providing to said pulse processing means an array of noise broadened filter coefficients; and said pulse processing means is responsive to said noise broadened filter coefficients for providing said first and second series of pulses.

3. The apparatus according to claim 2, wherein said pulse processing means comprises:

a noise shaping means having one input for receiving said pre-emphasized speech samples, and having another input coupled to said pre-emphasis correction means for receiving said corrected filter coefficients and another input coupled to said noise broadening means for receiving said noise broadened filter coefficients to provide at an output an array of noise shaped speech samples according to a given pole-zero filter format.

4. The apparatus according to claim 3, wherein said pulse processing means further comprises:

impulse response means coupled to said noise broadening means for providing at an output an impulse response according to said filter format.

5. The apparatus according to claim 4, wherein said pulse processing means further comprises:

auto-correlation means coupled to said impulse response means for providing at an output the auto-correlation signal of said filter format.

6. The apparatus according to claim 5, wherein said pulse processing means further comprises:

cross-correlation means coupled to said impulse response means and said noise shaping means for providing at an output the cross-correlation signal between said noise shaped speech and said impulse response.

7. The apparatus according to claim 6, wherein said pulse processing means further comprises:

pick pulse means coupled to said cross-correlation means and including correlation update means coupled to said cross-correlation means to provide at an output an array indicative of pulse amplitude and location according to a search of the maximum cross-correlation for determining the location and amplitude of the next pulse, wherein said correlation update means scales said impulse response auto-correlation by a value related to pulse amplitude.

8. The apparatus according to claim 7, wherein said pulse processing means further comprises:

an add pulse means having an input coupled to the output of said pick pulse means for providing a first array indicative of pulse location and a second array indicative of pulse amplitude and including means for storing said arrays.

9. The apparatus according to claim 8, wherein said pulse processing means further comprises:

overhange processing means coupled to said impulse response means for providing at an output a signal indicative of the overlap between framed speech.

10. The apparatus according to claim 9, wherein said pulse processing means further comprises:

receiving means coupled to said channel for receiving said digital signal as provided at said output of said buffer means, including:

input buffer means for storing said digital signal as a stored digital signal, means for reading said stored digital signal at a given bit rate for each frame, a linear predictive (LPC) decoder means coupled to said input buffer means for providing decoding filter coefficients from said stored digital signal, a pulse decoder means coupled to said input buffer for receiving said stored digital signal and for providing pulse amplitude and location signals to an excitation format means;

said excitation format means providing an excitation array indicative of pulse position and amplitude, a linear predictive synthesis filter means for receiving said decoding filter coefficients and for receiving said excitation array for providing at an output an analog speech signal.

11. The apparatus according to claim 10, further including:

decoder pre-emphasis correction means for receiving said decoding filter coefficients and providing corrected decoding filter coefficients to said linear predictive synthesis filter means.

12. Apparatus for converting analog speech into a digital signal for transmission of said digital signal over a conventional communications channel, comprising:

an analog to digital converter for converting said analog speech into digitized speech, pre-emphasis means responsive to said digitized speech for providing an array of pre-emphasized speech samples, memory means coupled to said pre-emphasis means for storing said array of samples, linear predictive coder means coupled to said memory means and responsive to said stored samples for providing a first array of reflection coefficients and a second array of filter coefficients, pole broadening means coupled to said linear predictive coder means and responsive to said second array of filter coefficients for providing an array of filter coefficients having a broadened bandwidth, said pole broadeneing means including means for multiplying each of said filter coefficients in said second array of filter coefficients by a given factor, and a pre-emphasis correction means coupled to said pole broadening means for receiving said array of broadened bandwidth filter coefficients for providing an array of corrected filter coefficients, pulse processing means coupled to said pre-emphasis means and said pre-emphasis correction means and responsive to said array of pre-emphasized speech samples and said corrected filter coefficients for providing a first series of pulses indicative of pulse amplitude and a second series of pulses indicative of pulse location, encoder means coupled to said pulse processing means for receiving said first and second series of pulses and for providing a stream of pulses indicative of a product code of said first and second series of pulses, output buffer means coupled to said linear predictive coding means for receiving said reflection coefficients and coupled to said encoder means for receiving said stream of pulses for providing at an output a digital signal of a given length bit stream having a bit rate determined according to said communications channel.

13. The apparatus according to claim 12, further including:

a noise broadening means responsive to said corrected filter coefficients for providing to said pulse processing means an array of noise broadened coefficients, said noise broadening means including multiplier means for multiplying each corrected filter coefficient by a given multiplication factor to provide said array of noise broadened coefficients.

14. The apparatus according to claim 13, wherein said pulse processing means further comprises:

a noise shaping means for receiving said pre-emphasized speech samples, and for receiving said corrected filter coefficients and for receiving said noise broadened coefficients for providing an array of noise shaped speech samples according to a given pole-zero filter format.

15. Apparatus for converting an analog speech signal into a digital signal, comprising:

a pre-emphasizer to an analog speech input, said pre-emphasizer providing a digital speech sample array;

a linear predictive coder for receiving said digital speech sample array and providing a reflection coefficient digital signal and a filter coefficient digital signal;

a pole broadener for receiving said filter coefficient digital signal and providing a pole broadened filter coefficient signal;

a pre-emphasis corrector for receiving said pole broadened filter coefficient signal and providing a corrected filter coefficient signal;

a pulse processor for receiving said corrected filter coefficient signal and said digital speech sample array, said pulse processor generating a first pulse array of amplitude indicating pulses and a second pulse array of position indicting pulses and providing a digital product code indicative of the product of said first pulse array of amplitude indicating pulses and said second pulse array of position indicating pulses;

an output means for receiving said digital product code and said reflection coefficient digital signal, said output means providing a digital output signal of a given length bit stream and having a predetermined bit rate and representative of said analog speech signal.

* * * * *